US005638578A

United States Patent [19]

Röck et al.

[11] Patent Number: 5,638,578

[45] Date of Patent: Jun. 17, 1997

[54] HINGE

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 671,780

[22] Filed: Jun. 20, 1996

[30] Foreign Application Priority Data

Jun. 20, 1995 [AT] Austria ..... 1047/95

[51] Int. Cl.[6] ..... E05D 7/10

[52] U.S. Cl. ..... 16/258; 16/382

[58] Field of Search ..... 16/257, 258, 259, 16/382, DIG. 43

[56] References Cited

U.S. PATENT DOCUMENTS

| | | | |
|---|---|---|---|
| 4,654,932 | 4/1987 | Röck et al. . | |
| 4,908,907 | 3/1990 | Rock et al. | 16/382 |
| 5,056,190 | 10/1991 | Rock et al. | 16/382 |

FOREIGN PATENT DOCUMENTS

| | | |
|---|---|---|
| 30 26 796 | 1/1982 | Germany . |
| 39 03 700 | 9/1990 | Germany . |
| 39 03 702 | 9/1990 | Germany . |

*Primary Examiner*—Daniel W. Howell
*Assistant Examiner*—Mark Williams
*Attorney, Agent, or Firm*—Wenderoth, Lind & Ponack

[57] ABSTRACT

A hinge for an article of furniture comprising a hinge arm and a mounting plate. The mounting plate is to be mounted on a side wall of said article of furniture and abuts a side face of the side wall with a mounting plane. The hinge arm is connected by means of a hinge axle to a hinge part adapted to be mounted on a furniture door. The hinge arm is fastened to the mounting plate by at least one locking member which is acted upon by a spring and is held on the mounting plate solely by means of the locking member. The mounting plate is provided with pegs extending perpendicularly to the mounting plane. The hinge arm comprising two arms defining an L. A first arm is aligned parallel to a front face of the side wall and a second arm is aligned parallel to the side face of said side wall. The locking member is a tilting lever pivoted on a pin extending perpendicularly from the second arm and is moveable in a plane parallel to the mounting plane between a locking position in which the hinge arm is fastened to the mounting plate and a non-locking position in which the hinge arm is removeable from the mounting plate. The tilting lever engages in slots provided at the sides of the pegs when in the locking position.

13 Claims, 5 Drawing Sheets

HINGE

BACKGROUND AND FIELD OF THE INVENTION

The invention relates to a hinge for an article of furniture comprising a hinge arm and a mounting plate for mounting on a side wall of said article of furniture and abutting a side face of said side wall with a mounting plane. The hinge arm is fastened to the mounting plate but least one locking member which is acted upon by a spring.

DESCRIPTION OF THE PRIOR ART

A hinge is known from U.S. Pat. No. 4,654,932 in which a spring catch mechanism is provided on the mounting plate. For mounting the hinge arm it is pushed onto the mounting plate. Projections of the hinge arm extend into recesses of the mounting plate.

SUMMARY OF THE INVENTION

It is the object of the invention to improve a hinge in which the hinge arm is fixed on the mounting plate by means of a spring catch mechanism in such a manner that a hinge arm having an arm abutting the front face of the furniture side wall can easily be mounted on the mounting plate. It is a further object of the invention to provide a hinge whereby two hinge arms can be mounted on the mounting plate.

According to the invention this is achieved by the mounting plate being provided with pegs extending perpendicularly to said mounting plane, the hinge arm comprising two arms defining an L, a first arm being aligned parallel to a front face of said side wall and a second arm being aligned parallel to said side face of said side wall, said locking member being a tilting lever pivoted on a pin extending perpendicularly from said second arm and being moveable in a plane parallel to said mounting plane between a locking position in which said hinge arm is fastened to said mounting plate and a non-locking position in which said hinge arm is removeable from said mounting plate, and engaging in slots provided at the sides of said pegs when in the locking position.

BRIEF DESCRIPTION OF THE DRAWINGS

An embodiment of the invention will now described in more detail with reference to the accompanied drawings in which.

DESCRIPTION OF THE PREFERRED EMBODIMENTS

Figure 1:
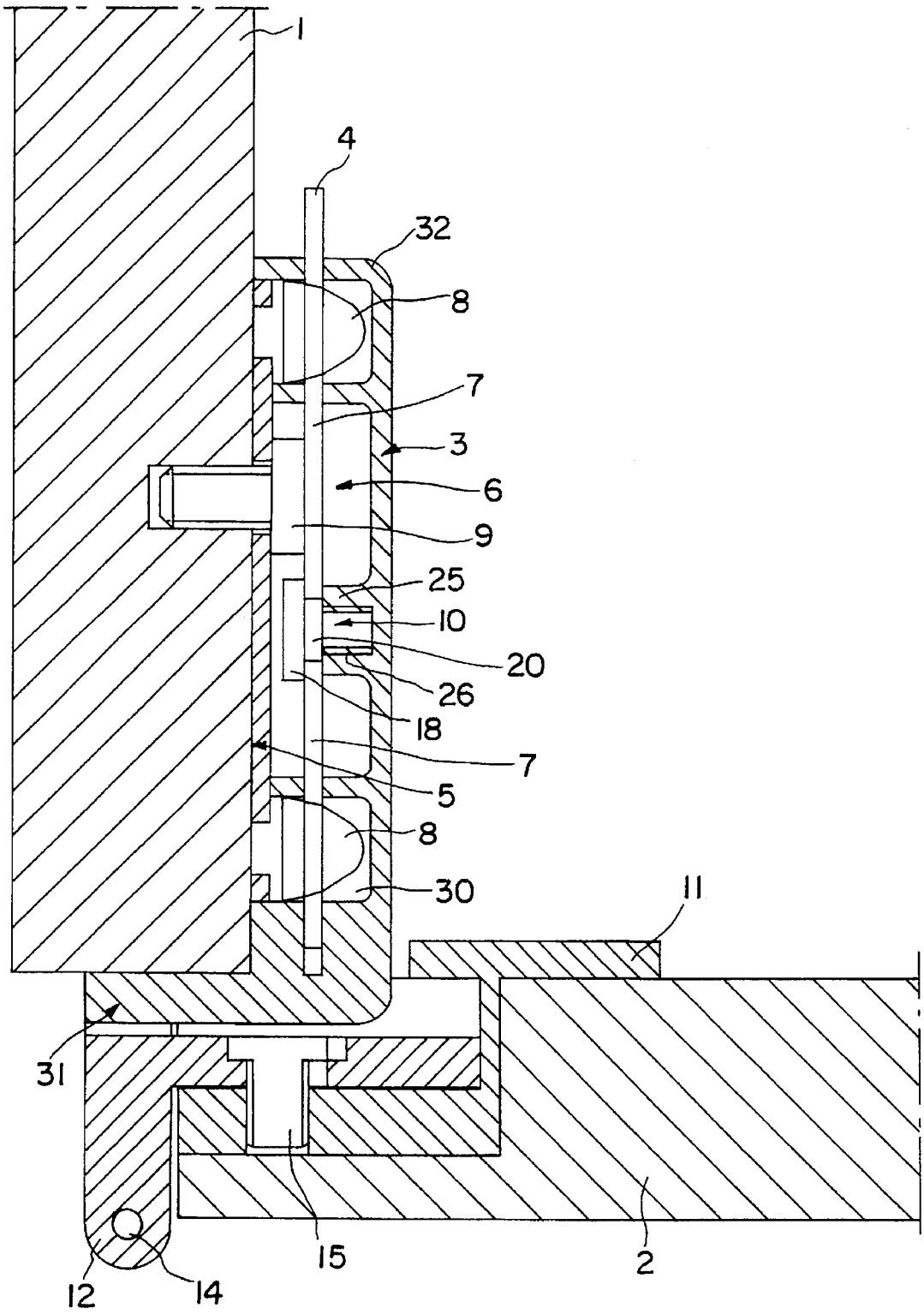
FIG. 1 shows a sectional view of a hinge according to the invention.
Figure 2:
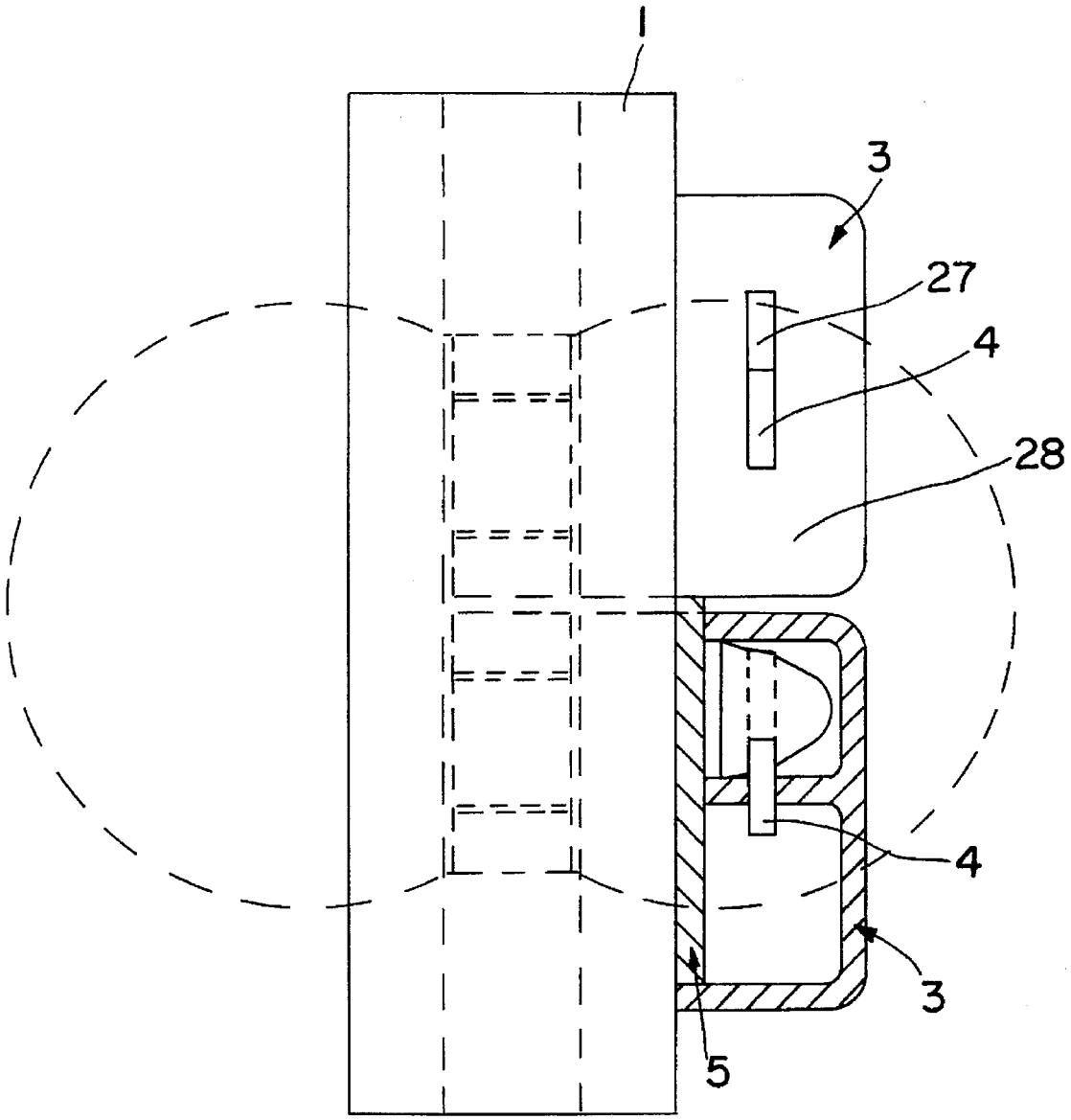
FIG. 2 shows a view of the rear side of a hinge arm and a sectional view of a second hinge arm.
Figure 3:
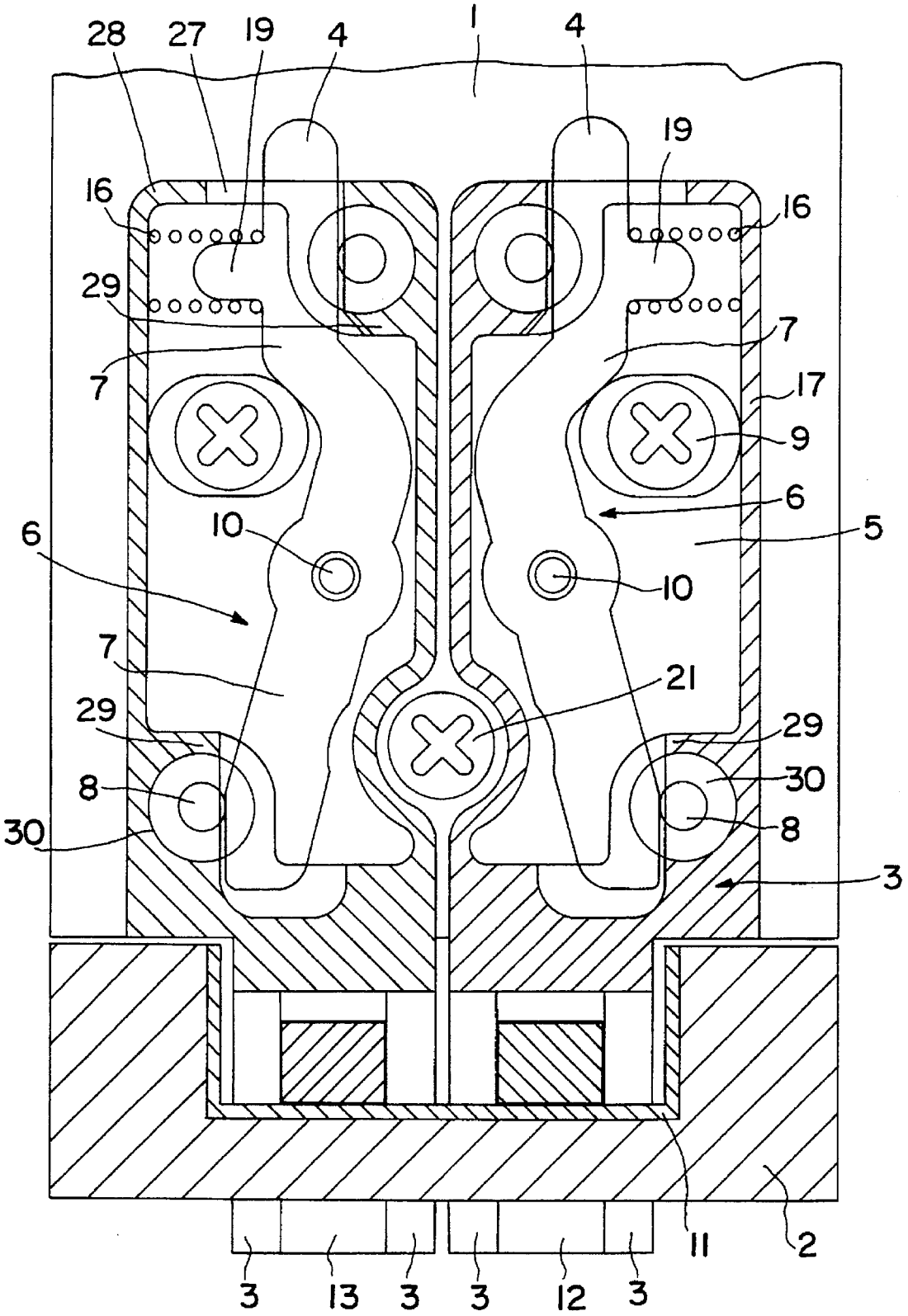
FIG. 3 shows a sectional view of two hinge arms.
Figure 4:
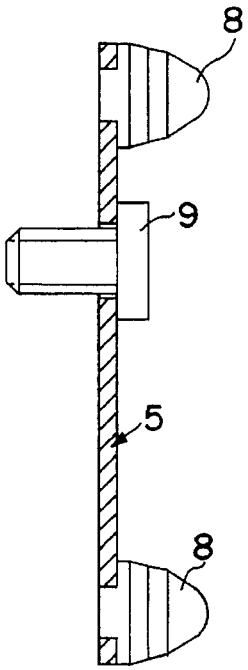
FIG. 4 shows a longitudinal sectional view of a mounting plate.
Figure 5:
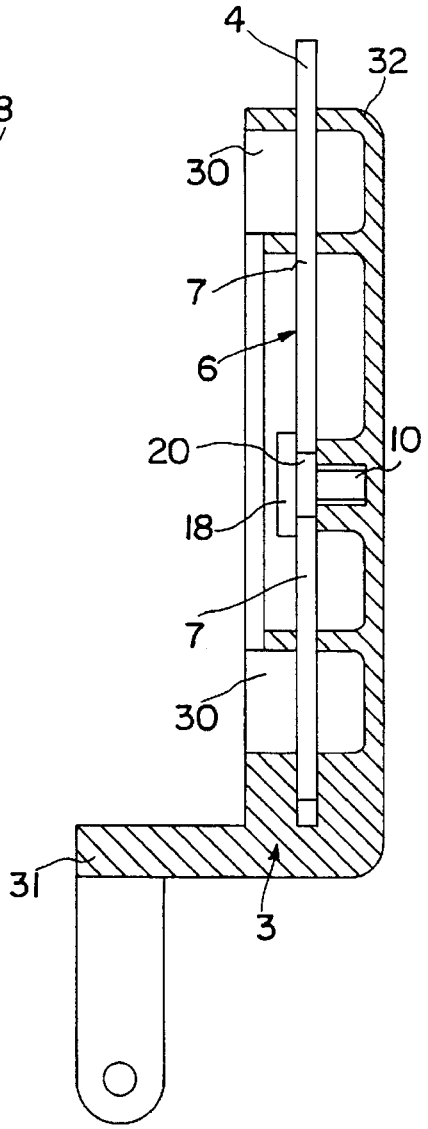
FIG. 5 shows a longitudinal sectional view of a hinge arm.
Figure 6:
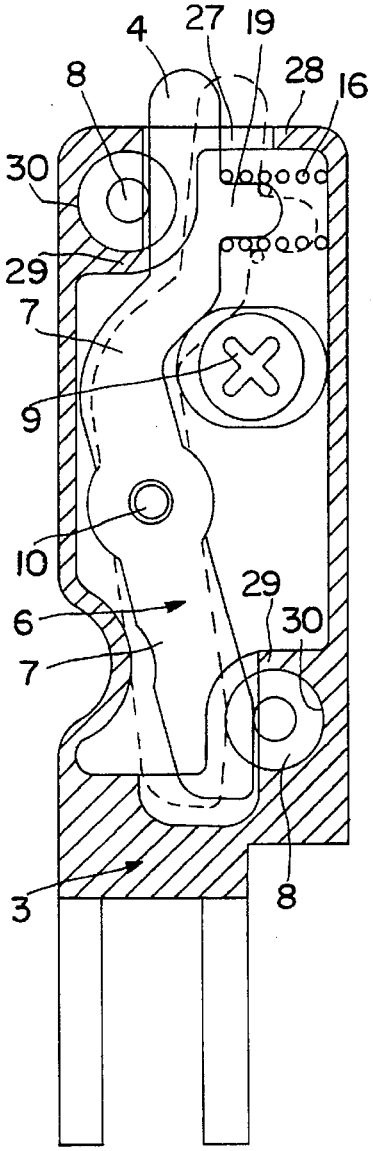
FIG. 6 shows a sectional view of a hinge arm mounted on the mounting plate.
Figure 7:
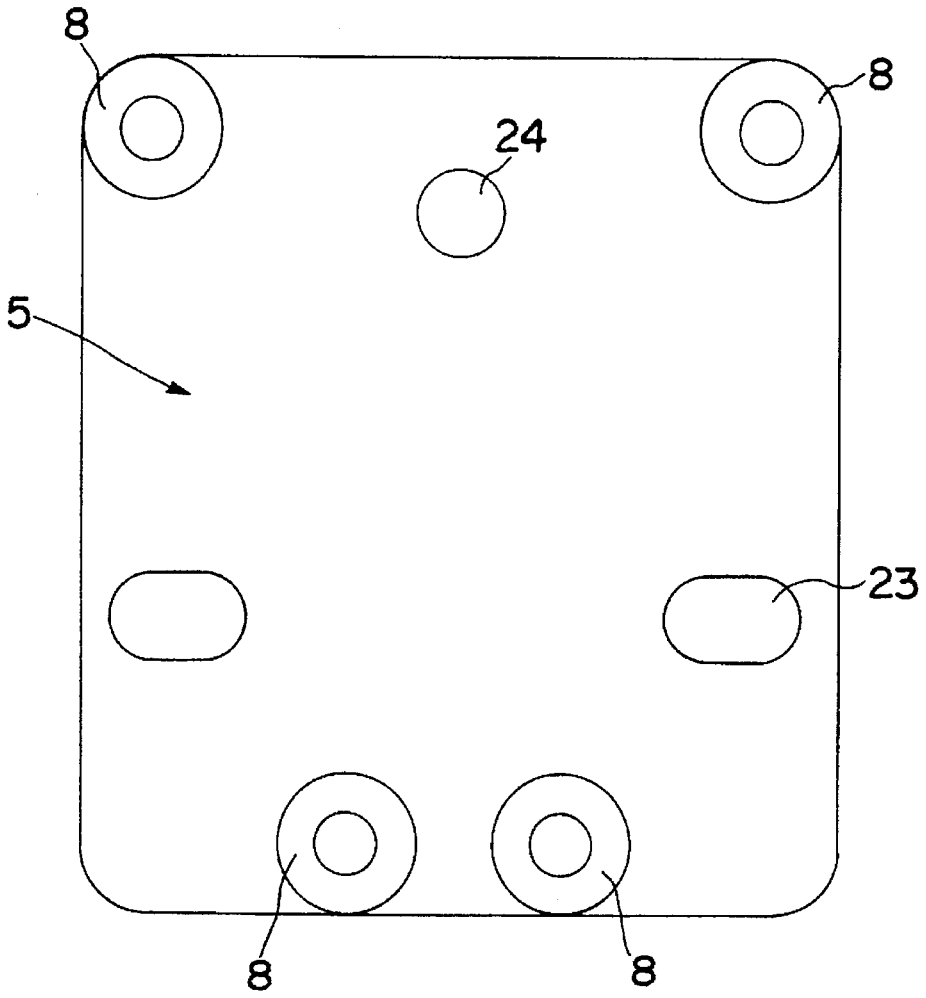
FIG. 7 shows a plan view of the mounting plate and FIG. 8 shows a side view of the mounting plate.
Figure 8:
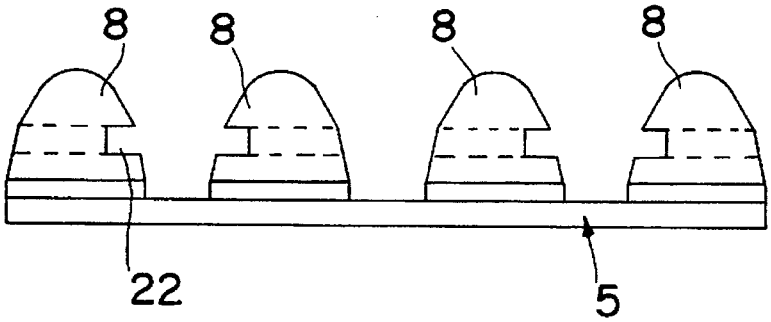

With a hinge according to the invention, one door 2 as well as two doom 2 can be hinged to a side wall 1 of a piece of furniture.

Each hinge arm 3 comprises two arms 31, 32 forming an L. The arm 31 abuts the front face of the furniture side wall 1. The second arm 32 is aligned parallel to the mounting plate 5. The arms 31 of the hinge arms 3 are pivotally connected to coupling parts 12 by means of a hinge axle 14. The coupling parts 12 are held in hinge casings 11 by means of clamping screws 15. The hinge casings 11 are situated in bores in the doors 2. Each clamping screw 15 is held in a female thread in the hinge casing 11.

The mounting plate 5 of the hinge is fastened to the furniture side wall 1. In the embodiment shown two hinge arms 3 can be mounted on the mounting plate 5.

The mounting plate 5 is provided with pegs 8 which again are provided with slots 22. The pegs 8 are situated adjacent to the front face and a rear face of the mounting plate 5. The pegs 8 adjacent to the rear face of the mounting plate 5 are nearer to each other than the pegs 8 adjacent to the front face. The mounting plate 5 is further provided with two slots 23 through which fastening screws 9 protrude and with a hole 24 through which a positioning screw 21 protrudes.

When the hinge is to be mounted on the piece of furniture the mounting plate 5 is clamped to the furniture side wall I by means of the fastening screws 9. By loosening the fastening screws 9 the mounting plate 5 is adjustable with respect to the height of the piece of furniture. When the mounting plate 5 is in the correct position with respect to the height of the piece of furniture the fastening screws 9 are turned tight and a bore hole is drilled into the furniture side wall whereby the drill moves through the hole 24 in the mounting plate 5. Than the positioning screw 21 is screwed into the furniture side wall extending through the hole 24.

As stated each hinge arm 3 comprises two arms 31, 32 defining an L. A first arm 31 is aligned parallel to the front face of the furniture side wall 1 and abuts said front face. The second arm 32 is aligned parallel to the side face of the furniture side wall 1. A tilting lever 6 is mounted at said second arm 32.

Each hinge arm 3 is on its second arm 32 provided with a small pedestal 25 having a female thread 26. A screw 10 is screwed into the female thread 26. The screw 10 has a threadless shank part 20 on which the tilting lever 6 is mounted. The screw 10 is provided with a screw head 18 by means of which the tilting lever 6 is held.

The tilting lever 6 is tiltable around the axis defined by the screw 10 and it is tiltable in a plane which is parallel to the mounting plane of the mounting plate 5 and therefore parallel to the side face of the side wall I of the piece of furniture.

The tilting lever 6 is a two-arm lever whereby when the hinge arm 3 is mounted on the mounting plate 5 both arms 7 of the tilting lever 6 rests in slots 22 of the pegs 8 of the mounting plate 5. In this way the hinge arm 3 is secured to the mounting plate 5.

Each tilting lever 6 is provided with a plug 19 and each plug 19 is a seat for a spring 16. The spring 16 is a pressure spring and a helical spring. The spring 16 thrusts on a side web of the hinge arm 3 and presses the tilting lever 6 in its locking position.

So that the hinge arm 3 can be removed from the mounting plate 5 without a tool the tilting lever 6 is provided with a handle part 4 which protrudes through a slot 27 in the rear web 28 of the hinge arm 3.

The hinge arm 3 is further provided with webs 29 which define chambers 30. When the hinge arm 3 is mounted on the mounting plate 5 the pegs 8 are situated in these chambers 30 without clearance. In this way a snug hold is provided for the hinge arm 3 on the mounting plate 5.

When the hinge arm 3 is fastened to the mounting plate 5 it can be moved perpediculary to the mounting plate 5 so that the first arm 31, which in the mounted position abuts the front face of the furniture side wall 1, does not obstruct the mounting of the hinge arm 3.

To facilitate mounting of the hinge arm 3 on the mounting plate 5 the pegs 8 are, at least at their free end, dome or cone-shaped. To mount the hinge arm 3 on the mounting plate 5, the hinge arm 3 only has to be pressed onto the mounting plate 5, whereby the tilting lever 6 is automatically pushed into the slots 22 by the spring 16. To remove the hinge arm 3 from the mounting plate 5 the tilting lever 6 can be moved out of the locking position by means of the handle part 4.

We claim:

1. A hinge for an article of furniture comprising a hinge arm and a mounting plate for mounting on a side wall of said article of furniture, said mounting plate having a mounting plane, said mounting plane to abut a side face of said side wall, the hinge arm being connected by means of at least one hinge axle to a hinge part adapted to be mounted on a furniture door, said hinge arm being fastened to the mounting plate by at least one locking member which is acted upon by a spring and being held on the mounting plate solely by means of said locking member, the mounting plate being provided with pegs extending perpendicularly to said mounting plane, the hinge arm comprising two arms defining an L, a first arm being to be aligned parallel to a front face of said side wall and a second arm to be being aligned parallel to said side face of said side wall, said locking member being a tilting lever pivoted on a pin extending perpendicularly from said second arm and being moveable in a plane parallel to said mounting plane between a locking position in which said hinge arm is fastened to said mounting plate and a non-locking position in which said hinge arm is removeable from said mounting plate, and engaging in slots provided at the sides of said pegs when in the locking position.

2. A hinge as claimed in claim 1, wherein at least two pegs are provided.

3. A hinge as claimed in claim 2, wherein four pegs are provided on said mounting plate and two hinge arms are mounteable on said mounting plate next to each other.

4. A hinge as claimed in claim 3, wherein the pegs are situated adjacent to a front face and a rear face of said mounting plate, the pegs adjacent to one face being nearer to each other than the pegs adjacent to the other face.

5. A hinge as claimed in claim 1, wherein the pin is a screw which is screwed into the hinge arm.

6. A hinge as claimed in claim 1, wherein the tilting lever is a two armed lever each arm resting in a slot of a peg when the hinge arm is secured to the mounting plate.

7. A hinge as claimed in claim 1, wherein the locking member is made of sheet metal.

8. A hinge as claimed in claim 1, wherein the hinge arm is box shaped and the spring acting on the tilting member struts on a side wall of said hinge arm.

9. A hinge as claimed in claim 1, wherein the pegs protrude into chambers in the hinge arm said chambers being defined by walls having slots through which the tilting member protrudes and wherein the walls are cylindrical over at least part of their circumference and the pegs are held in the chambers without clearance.

10. A hinge as claimed in claim 1, wherein the spring is a pressure spring and a helical spring and the tilting lever is provided with a plug protruding into said spring.

11. A hinge as claimed in claim 1, wherein the pegs are dome shaped.

12. A hinge as claimed in claim 1, wherein the pegs are cone shaped.

13. A hinge as claimed in claim 1, wherein the mounting plate is provided with two slots through which fastening screws protrude and a circular hole through which a positioning screw protrudes.

* * * * *